US006988617B2

(12) United States Patent
Gomes et al.

(10) Patent No.: US 6,988,617 B2
(45) Date of Patent: Jan. 24, 2006

(54) BOTTOM LOCKING CARTON

(75) Inventors: Jean-Manuel Gomes, Marietta, GA (US); Raymond Spivey, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 288 days.

(21) Appl. No.: 10/386,096

(22) Filed: Mar. 10, 2003

(65) Prior Publication Data

US 2004/0178084 A1 Sep. 16, 2004

(51) Int. Cl.
*B65D 75/00* (2006.01)

(52) U.S. Cl. ..... 206/434

(58) Field of Classification Search ..... 206/139, 206/140, 141, 145, 148, 149, 170, 200, 427–435
See application file for complete search history.

(56) References Cited

U.S. PATENT DOCUMENTS 3,194,476 A * 7/1965 Weiss ..... 206/140
4,815,599 A * 3/1989 Schuster ..... 206/427
5,060,792 A * 10/1991 Oliff ..... 206/140
5,311,984 A * 5/1994 Harris ..... 206/140
5,542,536 A * 8/1996 Sutherland ..... 206/427
5,597,071 A * 1/1997 Sutherland ..... 206/434
5,605,228 A * 2/1997 Baxter ..... 206/427
5,609,251 A * 3/1997 Harris ..... 206/434
5,647,483 A * 7/1997 Harris ..... 206/427
5,653,341 A * 8/1997 Miret ..... 206/434
5,682,995 A * 11/1997 Sutherland ..... 206/429
5,957,289 A * 9/1999 Negelen ..... 206/434
6,021,899 A * 2/2000 Sutherland ..... 206/427
6,378,697 B1 * 4/2002 Sutherland et al. ..... 206/140
6,415,917 B1 * 7/2002 Marco ..... 206/147
6,527,108 B1 * 3/2003 Blin et al. ..... 206/148
6,736,260 B2 * 5/2004 Gomes et al. ..... 206/175

* cited by examiner

*Primary Examiner*—Kurt Fernstrom
(74) *Attorney, Agent, or Firm*—Womble Carlyle Sandridge & Rice, PLLC

(57) ABSTRACT

A wrap-around carton for carrying a plurality of containers, with each container having an indentation in the bottom with the carton having open ends with means to secure the tops of the containers from falling out of the open ends and a locking tab struck from the bottom panel and fitting into the indentation in the bottom of the container to prevent the bottom of the container from falling out of the carton. The locking tab is held securely in the bottom of the container by a holding tab between the locking tab and the bottom panel of the carton.

24 Claims, 4 Drawing Sheets

BOTTOM LOCKING CARTON

BACKGROUND OF THE INVENTION

1. Field of the Invention

The present invention relates generally to a wrap-around can carton with open ends, which has retaining flaps in the upper corners on each end with bottom locks that lock into the indentation in the bottom ends of the cans to prevent the cans from falling out. This carton may have locks for securing the bottom flaps of the carton together.

2. Prior Art

Wrap-around cartons have been used in the past. When fabricating a carton from a paperboard blank, opposite sides of the blank are conventionally attached to each other by glue or by mechanical locks to form the bottom panel of the carton. In the case of a wrap-around carton, flaps located on the sides of the blank typically are overlapped and engaged with one another by mechanical locks formed in the flaps to form the bottom panel of the carton. Since the bottom panel must maintain its integrity throughout the use of the carton, it is essential that the locking system by capable of supporting the weight of the packaged articles, and remain engaged during shipping and handling of the constructed carton.

One approach to provide such a stable mechanical lock assembly utilizes primary and secondary locks. The primary locks connect the ends of the carton together via the flaps, while the secondary locks function to maintain the engaged flaps in place in order to provide a "backup" locking system to prevent the primary locks from separating. A superior locking system that overcomes many of the deficiencies of prior art locks is disclosed in U.S. Pat. No. 5,443,203 to Sutherland, which describes a mechanical locking system that does not require secondary male locking tabs to extend beyond the end edges of the blank, but which system effectively locks the tabs in place and resists withdrawal of the tabs.

U.S. Pat. No. 4,708,284 (Sutherland, et al.) issued on Nov. 24, 1987 discloses a locking arrangement including both primary and secondary male locks which utilizes a single female aperture for receiving both the primary and secondary male lock.

It would be advantageous to provide a wrap-around carton with open ends which has some means of holding the bottoms of the cans in place so they do not fall out of the open ends of the carton. This would reduce the amount of paperboard required to produce the carton as the carton has open ends.

SUMMARY OF THE INVENTION

It is an object of the present invention to provide an open ended wrap-around carton for cans that has retaining flaps in the upper corner of each end of the carton and some means of holding the bottoms of the cans in place without the necessity of having retaining flaps on the bottom of the carton.

It is the further object of this invention to provide a mechanism for holding cans that have an indentation in the bottom of the can for utilizing the indentation to hold the bottom of the can securely within the carton. It is a further object of this invention to provide a open ended carton for holding cans that does not require retaining flaps at the corners at the bottom of each end of the carton, which would require more paperboard to produce the carton. It is another object of this invention to achieve these objectives with a carton that has a primary and secondary locking system.

These objects are achieved by providing a wrap-around carton for containing cans with an indentation in the bottom of the cans, which in its preferred embodiment has a top panel, side panels and bottom flaps with a locking system for locking the carton together. This carton has a retaining flap at each top corner of the carton that is held in place by a tuck-in panel that is wedged between the can adjacent the end and the side panel. The bottom flaps are held together by primary and secondary male locks in one bottom flap that are locked into a single female opening in the other bottom flap that has a primary female locking ledge and a secondary female locking ledge holding the primary and secondary locks engaged.

This wrap-around carton is designed to be used with cans that have an indentation in the bottom surrounded by a rim. A locking tab is struck from a bottom flap and adjoining side panel to fit inside the indentation in the bottom of an adjacent can. This locking tab has a curved outside edge which fits against the inside curved bottom rim of a can. The locking tab is held in position securely against the bottom curved rim of the can by a holding tab which is foldably connected to the locking tab. The holding tab is foldably connected to the bottom flap which is connected to the side panel. This holding tab should have a height that is not significantly higher than the height of the indentation in the bottom of the can, and preferably is significantly less than the height of the indentation. The locking tab preferably has a diameter much less than the diameter of the indentation in the bottom of the can, and may be less than one-half (½) the diameter of the indentation and may be as small as approximately one-fourth (¼) of the diameter of the indentation.

During the forming of the wrap-around carton, a compression finger pushes the locking tab into position in the indentation of an adjacent can. The compression finger first pushes the locking tab in along the fold line between the locking tab and the holding tab. The compression finger continues pushing on the locking tab and pushes the curved end of the locking tab against the inside of the curved rim in the bottom of the can closest to the side panel. The final pushing is along the fold line between the holding tab and bottom flap which tightens the carton around the cans. The compression finger is then removed and the locking tab is held firmly in position by the holding tab. A cross section of the locking tab, holding tab and bottom flap is in a Z configuration.

Preferably, in this wrap-around carton retaining flaps and tuck-in panels hold the tops of the cans in position. Only the locking tabs hold the bottom ends of the cans in the carton.

This carton is preferably a locked carton with primary and secondary locks utilizing a single aperture that has a primary female locking ledge and a secondary female locking ledge. The bottom locks are preferably used with cartons containing containers arranged in two rows. It should be understood that this wrap-around carton using locking tabs to secure the bottom of cans could utilize other locking systems or could be glued. In addition other types of retaining means could be used to hold the top ends of the cans securely in position in the carton. The bottom lock of this invention could be used with other types of containers, such as square containers, with an indentation surrounded by a rim in the bottom. In this case the locking tab preferably has a straight end.

DETAILED DESCRIPTION OF THE PREFERRED EMBODIMENT

Figure 3:
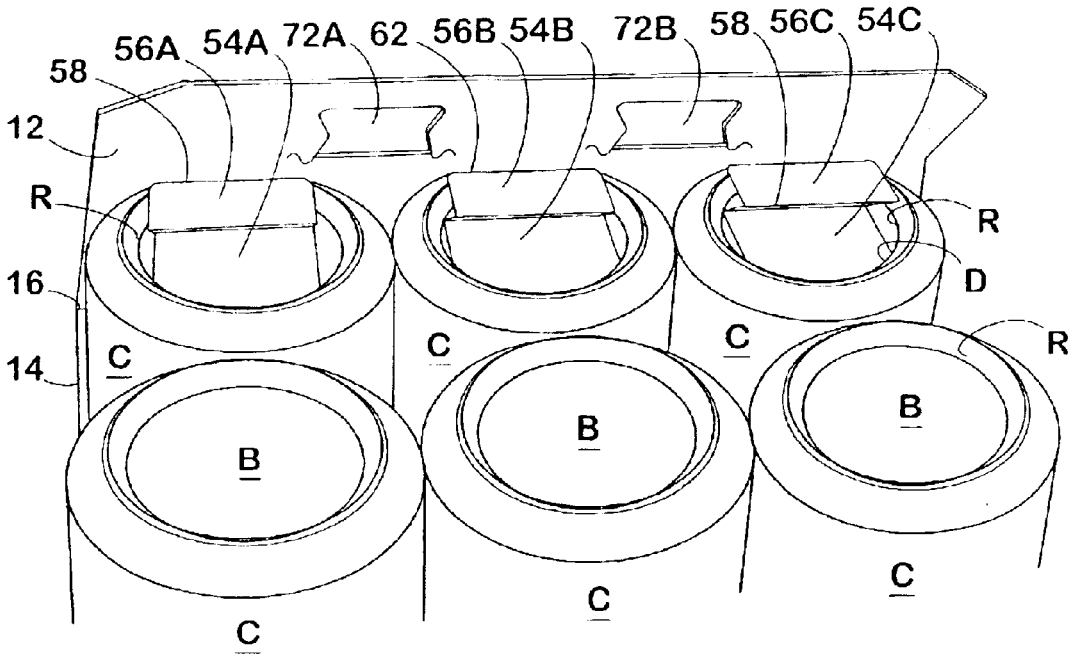
FIG. 3 is a view of the bottom of the cans with the bottom flap having been pushed partly into position and the locking tab having being pushed partly into a position in the indented bottoms of one row of cans.

The present invention is intended primarily for use with wrap-around cartons containing cylindrical containers, such as cans, used to contain soft drink, beer, and the like. A typical example of such a can C is illustrated in FIG. 3. This can has an indented bottom B and a bottom curved rim R as illustrated in FIG. 3. The can may have a typical top with a tab for opening the can to pour out the contents.

Figure 1:
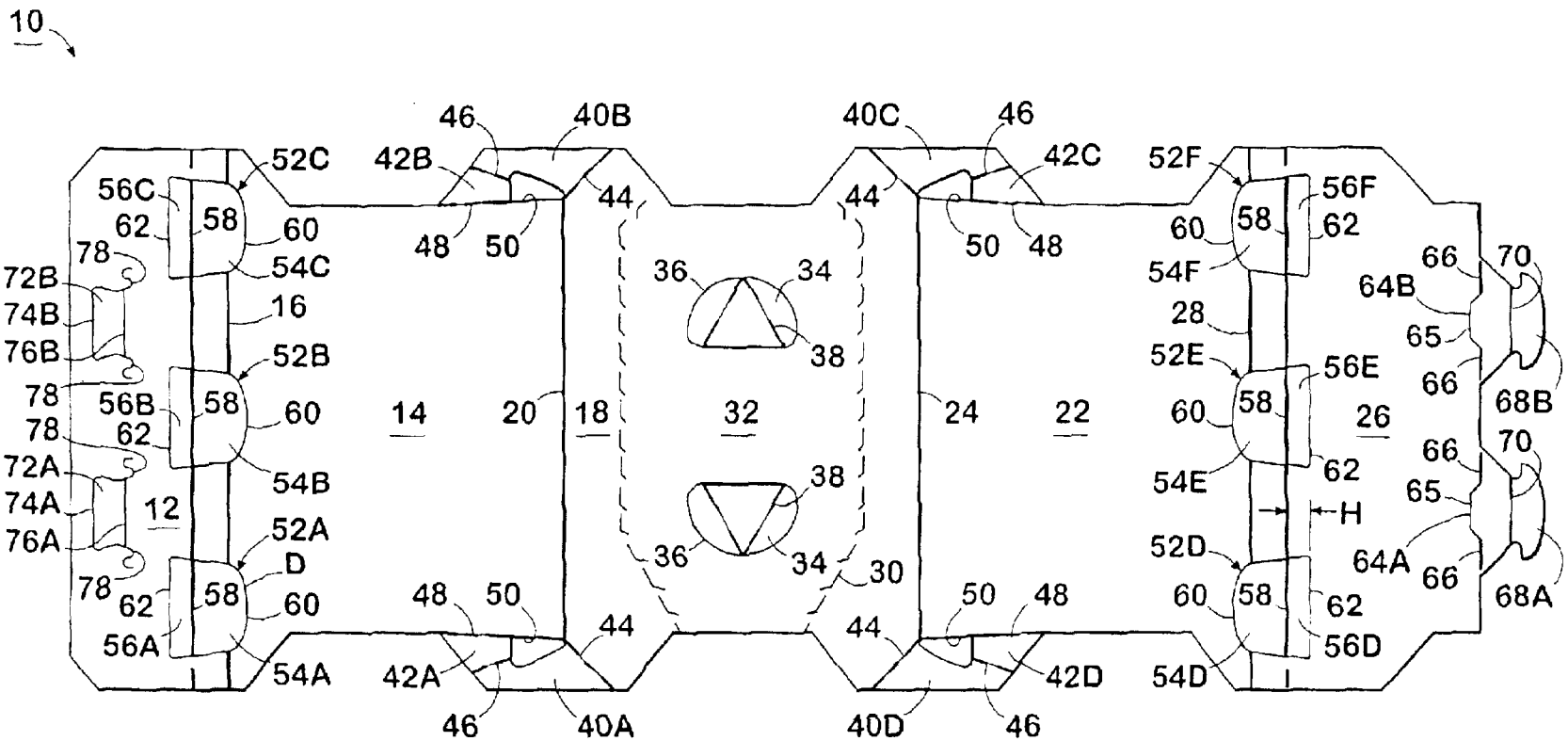
FIG. 1 is a plan view of a blank for a wrap-around carton which incorporates the features of an embodiment of the present invention.

The blank for forming the carton of the preferred embodiment is illustrated in FIG. 1. The blank 10 is designed to contain six beverage cans C in two rows of three each. The blank 10 is formed from a foldable sheet material, such as paperboard. The blank 10 has a bottom flap 12 which is foldably connected to side panel 14 by fold line 16 and in turn connected to top panel 18 by fold line 20. The top panel 18 is connected to side panel 22 by fold line 24 and in turn connected to bottom flap 26 by fold line 28. The top panel may have a tear line 30 forming an opening flap 32, that when removed provides easy access to the cans C. Finger flaps 34 may be formed in the top panel 18 by tear lines 36. These finger flaps 34 may have crease lines 38 so that when a person wishes to carry the wrap-around carton the finger flaps 34 can be easily pushed in and then carried by a person's finger and thumb.

It will be understood by those in the art that the preferable blank 10 is symmetrical about a horizontal line of bisection, as viewed when FIG. 1 is rotated lengthwise. This symmetry aids in the efficient production of the present wrap-around carton. The carton need not have such symmetry, although it is preferred. As shown, the blank is rectangular and includes straight edges, which makes for an efficient layout of the blanks in a web from which the blanks are cut.

In order to hold the tops of the cans C from falling out of the wrap-around carton formed from the blank of FIG. 1, retaining flaps 40A–D may be formed at the four upper corners of the carton. These retaining flaps 40A–D are foldably attached to the top panel 18 by fold lines 44 and each is attached to a tuck-in panel 42A–D by fold line 46. The tuck-in panels 42A–D are in turn attached to side panels 14 and 22 by fold lines 48. A stress aperture 50 may be formed between each retaining flap 40A–D and respective tuck-in panel 42A–D and the adjacent side panel 14 or 22.

A bottom lock 52A–F is formed in bottom flaps 12 and 26 for holding the bottoms of the cans C. Each bottom lock 52A–F has a locking tab 54A–F which is struck largely from the bottom flap 12 or 26, but a portion may be struck partially from the adjacent side panel 14 or 22. Each bottom lock 52A–F has a holding tab 56A–F which is connected to the locking tab 54A–F by fold line 58. A tear line 60 which extends around each locking tab 54A–F and the sides of the holding tab 56A–F for the folding of the bottom lock into position is provided. The holding tab 56A–F is foldably attached to the bottom flap 12 or 26 by fold line 62.

A wrap-around carton of this invention may be glued together or may have a conventional locking system. The locking system shown in the preferred embodiment includes both a primary locking and a secondary locking system. The primary and secondary male locks are formed in bottom flap 26. Primary male locks 64A–B are formed in bottom panel 26 by cut line 65. The primary male locks 64A–B are separated by fold line 66. Secondary male locks 68A–B are formed as an extension of bottom flap 26 and may have a fold line 70 to facilitate locking.

In the embodiment illustrated in FIG. 1, a single female opening 72A–B is provided for locking each set of primary male locks 64A–B and secondary male locks 68A–B. Each female opening 72A–B has a primary female locking ledge 74A–B for locking a primary male lock 64A–B. In addition, each female opening 72A–B has a secondary female locking ledge 76A–B which may have secondary female locking slits 78 for receiving the secondary male locks 68A–B.

During the locking of the blank 10 illustrated in FIG. 1 the primary male locks 64A–B are hooked over the primary female locking ledges 74A–B during the locking of the carton. The primary male locks 64A–B connects the ends of the wrap-around carton together via bottom flaps 12 and 26.

The secondary locking system consists of secondary male locks 68A–B and secondary female locking ledges 76A–B. The secondary locking system is basically a "back-up" locking system for the primary locking system. It should be understood that other locking systems may be used for the wrap-around carton of this invention. For example, in place of having a single female opening 72A–B for both the primary male lock 64A–B and the secondary male lock 68A–B, a primary female aperture and the second female aperture may be used to secure the primary male locks and secondary male locks (not shown).

It should be understood that other locking systems may be used for this wrap-around carton. In addition, this carton may be secured together by glue.

The wrap-around carton of this embodiment of the invention is formed from the blank of FIG. 1 by moving the top panel 18 of the blank over the top of six cans C and in the process fingers on the wrap machine push tuck-in panel 42A–D so that it is wedged between a can C at an open end of the carton and an adjacent side panel 14 or 22. This results in pulling the attached retaining flap 40A–D around a portion of the top of the can C as illustrated in FIG. 5.

Figure 2:
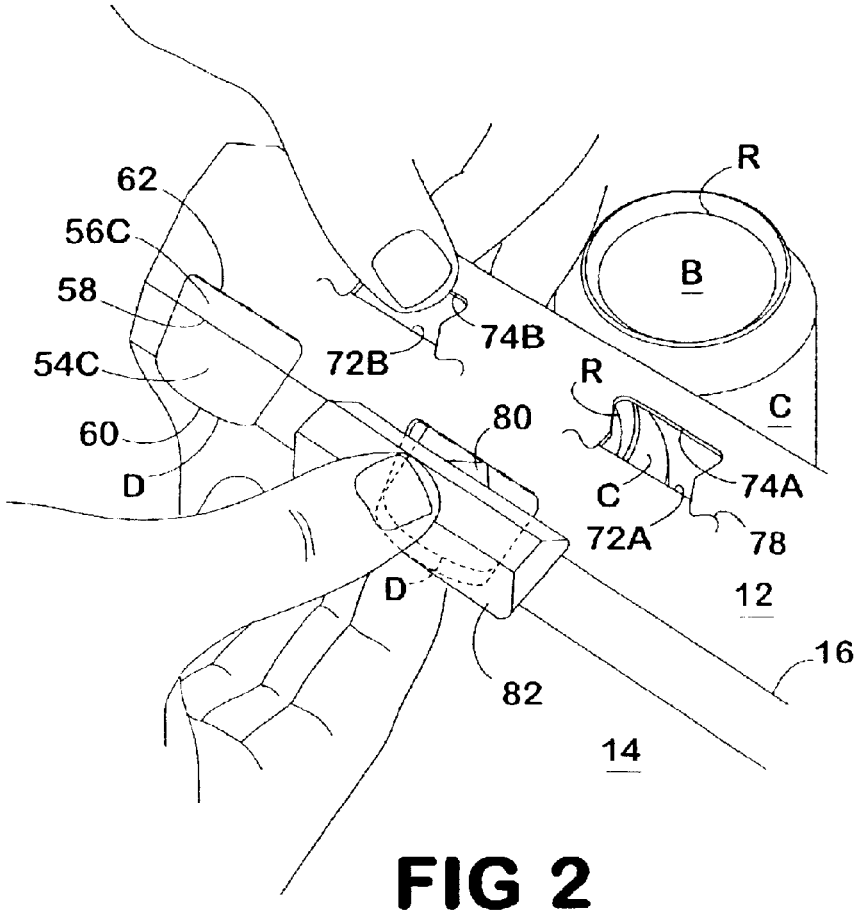
FIG. 2 is a partial view of the bottom of the wrap-around carton made from the blank of FIG. 1 which shows a compression finger attached to a lug on a wrapping machine (not shown)pushing the locking tab into the locked position.
Figure 4:
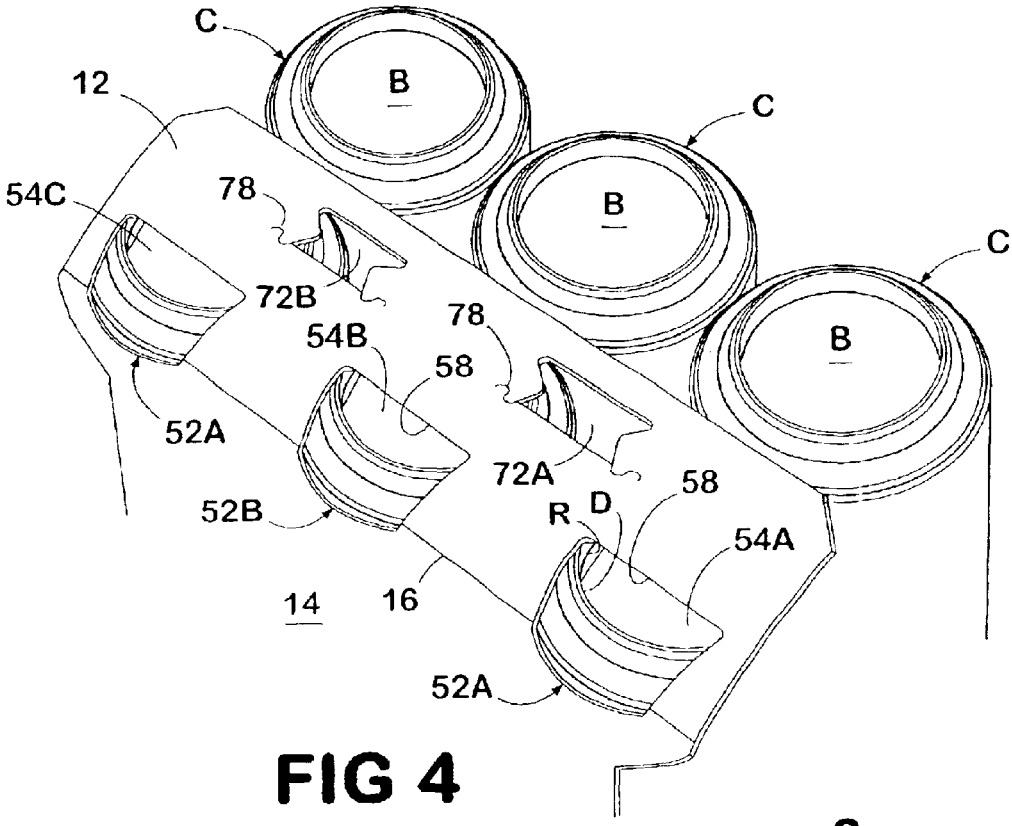
FIG. 4 is a partial view of one bottom flap of the wrap-around carton made from the blank illustrated in FIG. 1 showing three of the locking tabs in the locked position in the indented bottoms of the cans in one row of cans.
Figure 6:
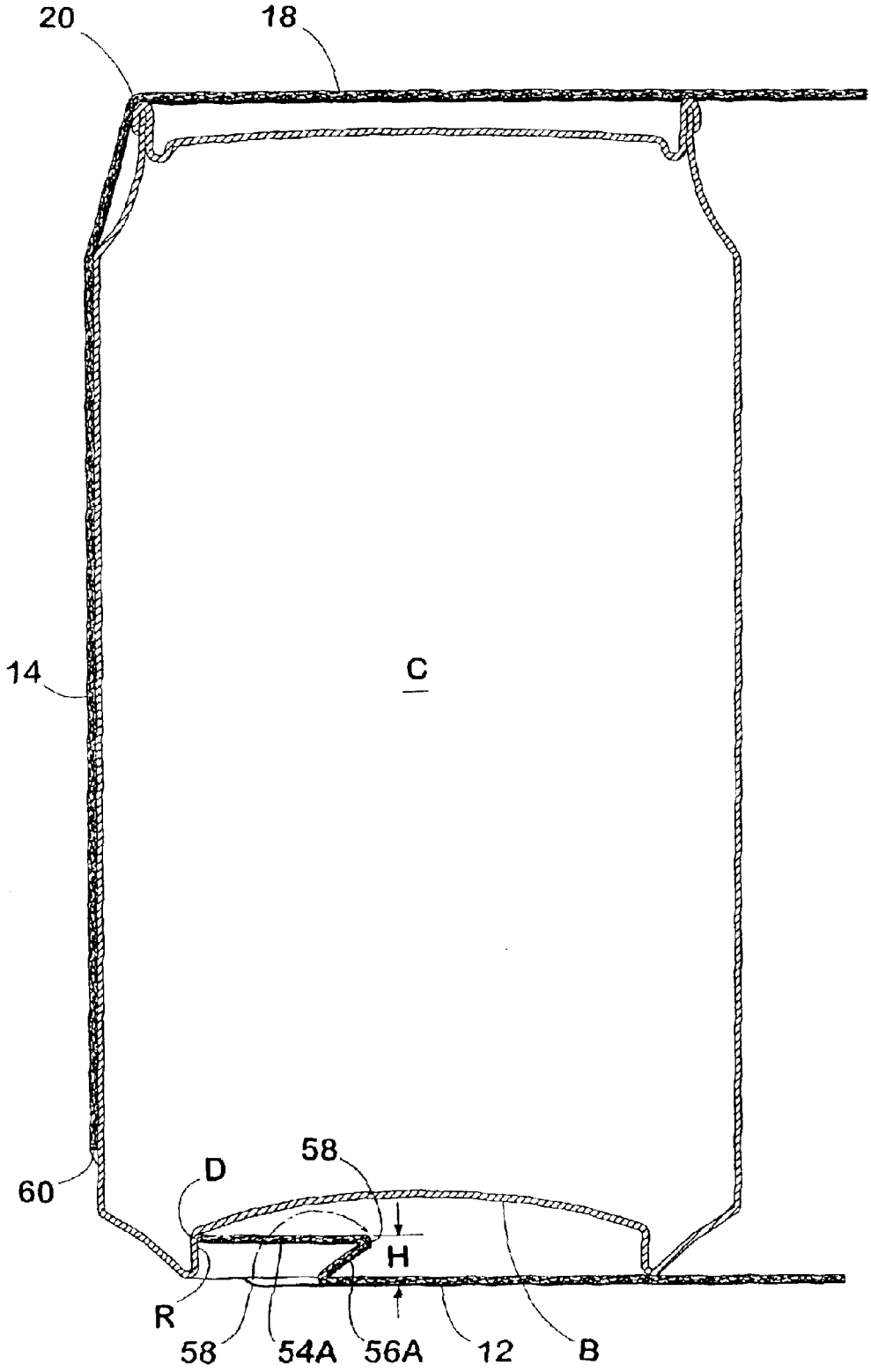
FIG. 6 is a cross sectional view taken along line 6—6 in FIG. 5 of one holding tab in a bottom flap that is in the locked position in the indented bottom of a can.

The side panels 14 and 22 are folded along the sides of the can C and the bottom flaps 12 and 26 folded along fold lines 16 and 28, respectively, over the bottoms of the cans. A compression finger 80 attached to a lug 82 on the wrap machine pushes each holding tab 56A–F inwardly into the carton wrap and pushes along fold line 58 until the locking tab 54A–F is pushed into a snug fit in the indented bottom B of the can C as illustrated in FIGS. 2, 4 and 6. Each locking tab 54A–F has a curved outside edge D that fits inside the indented bottom B of the can C and rests against the bottom curved rim R of the can C that is adjacent to the side panel 14 or 22 in bottom flap 12 or 26 from which the respective bottom lock 52A–F is struck. This results in each bottom lock 52A–F fitting in to the indented bottom B of the can C as illustrated in the cross-sectional view shown in FIG. 6. When the final locking of the wrap-around carton is complete this curved outside edge D of a locking tab 54A–F fits snugly against the bottom curved rim R of the can, which results in holding the bottom B of the can C securely in the wrap-around carton. As illustrated in FIG. 6, the locking tab 54A, the holding tab 56A and the bottom flap 12 form a Z configuration in a cross-sectional view.

The wrap-around carton is locked by pushing the primary male locks 64A–B into the respective female openings 72A–B securing the primary male lock 64A–B over the primary female locking ledge 74A–B. At the same time secondary male locks 68A–B are hooked over the secondary female locking ledges 76A–B with their ends being pushed through secondary female locking slits 78. Compression finger 80 may be pushed against the fold lines 62 to complete the tightening of the wrap-around carton. When finished wrapping, a portion of bottom flap 26 lies outside of bottom flap 12.

Figure 5:
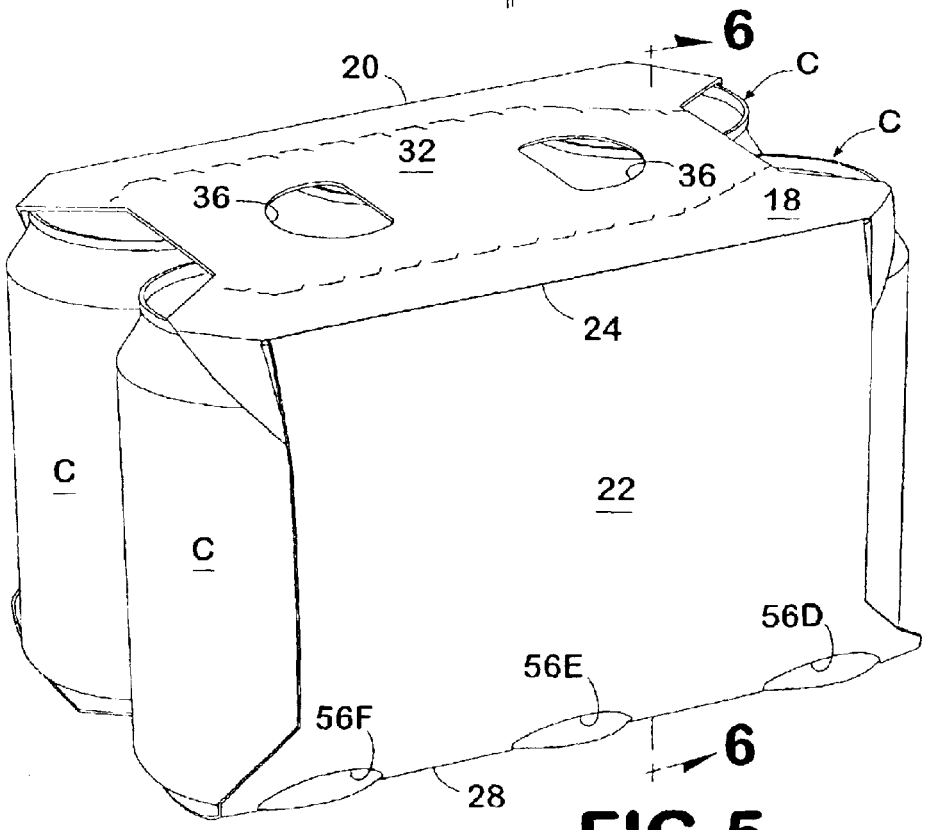
FIG. 5 is a perspective view of the wrap-around carton made from the blank of FIG. 1 and loaded with cans.

The tops of the cans in each open end of the carton are held within the carton by retaining flaps 40A-D extending around an outside portion of the top of the can C as illustrated in FIG. 5. The respective tuck-in panel 42A–D is wedged between the respective side panel 14 or 22 and the top of an adjacent can C. Because this tuck-in flap is wedged between a side panel and can, it holds the retaining flap firmly in position, holding the top of the can C securely within the wrap-around carton. As this wrap-around carton is tightened securely around the cans, the pressure between two adjacent cans on each end of the carton prevents the cans in each open end from falling out. It should be realized that other types of retaining mechanism, including other types of flaps, may be used to retain the tops of the cans securely within the wrap-around carton.

The bottoms of the cans C are held in position by bottom locks 52A–F. It is preferred that the bottom locks be inserted into the indented bottom B of all the cans. However, it is essential that these bottom locks 52A–F be inserted into the indented bottom B of all the cans C adjacent the open ends of the wrap-around carton.

As pointed above the compression finger 80 held by a lug on the wrap machine pushes the locking tab 54 and the holding tab 56 inwardly as illustrated in FIG. 2. This process is completed before the primary and secondary locking systems are engaged. The completion of the step of engaging the locking tab 54 is illustrated in FIG. 3 which is a view of the bottom of the cans in which the locking tabs 54A–C have been pushed into position on one row of cans. As illustrated in FIG. 4 the locking tabs 54A–C with a curved outside edge D fits snuggly against the inside surface of the bottom curve rim R of a can C. It will be noticed from FIG. 4 that the locking tab 54A–F fits against the inside surface of a bottom curved rim R of the can that is immediately adjacent to side panel 14. It is important that holding tabs 56A–F have a height H as illustrated in FIG. 1 and FIG. 6 that fits within the indented bottom B of the can C as illustrated in FIG. 6. This height H is preferably less than the height of the indented bottom B of the can. However it should be pointed out that the height could be somewhat greater than the height of the indented bottom B of the can, which would result in some crushing of the holding tab 56A–F. However the height H of the holding tab 56A–F cannot be significantly greater than the height of the indented bottom B of the can.

The locking tabs 54A–C as illustrated in FIG. 4 have a curved outside edge D that is held firmly against the inside surface of the curved rim R of the can C. The holding tab 56 has a memory that tends to push it back into the plane of the blank as illustrated in FIGS. 1 and 6. The distance between the curved outside edge D and fold line of each locking tab 54A–F must be less than the diameter of the indented bottom B of the can C between the inside surfaces of the bottom curved rim R of the can. Preferably the distance between the curved outside edge D of each locking tab 54A–F and fold line 58 is less than half the diameter of the bottom of the can C between the inside surfaces of the bottom curved rim R of the can as illustrated in FIG. 3. Preferable the distance between the curved outside edge D of the locking tab 54A–A and fold line 58 is one fourth or less of the diameter of the indented bottom B of the can between the inside surfaces of the bottom curved rim R of the can. The locking tab 54, holding tab 56 and bottom flap 12 or 26 form a Z configuration when viewed in cross section as shown in FIG. 6.

While the bottom lock of this invention is shown in an embodiment with cans, it should be realized that the bottom lock could be used with other types of containers (e.g. having a square bottom) as long as the container has a bottom indentation into which a locking tab can be inserted. It is preferable that the outside edge of the locking tab is of the same configuration as the inside rim of the container it is designed to hold.

Thus, the combination of the bottom lock of this invention, which holds the bottom of the cans in place, and the top retaining flaps which holds the tops of the cans from falling out results in producing a tightly packed wrap-around carton that secures the cans snugly within the wrap-around carton.

This is a very economical wrap in that there is no necessity to enclose the ends of the carton and the bottoms of the cans are held in position by the bottom locks which otherwise would be wasted material as the aperture formed by the bottom locks would be necessary to provide a place through which the compression fingers of the wrapping machine could be inserted to tightly wrap the wrap-around carton around the cans. Thus, a wrap-around carton that securely holds the cans in place is provided, which greatly reduces the amount of paperboard used to construct the carrier. While this embodiment shows the carton being used with six cans, it should be realized that it could be used with four cans or more than six cans as long as they are in two rows.

It should be realized that the geometry between the locking tab 54 and the holding tab 56 and the indented bottom of the can is important so that the holding tab retains its memory and tends to push the locking tab back into the plane in which it was formed in a blank.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed:

1. A wrap-around carton with two open ends for carrying a plurality of containers, each container having a top and bottom with an indentation with a height in the bottom comprising:

a. a top panel which is interconnected to side panels which are connected to a bottom panel;

b. said carton having a locking tab for holding the bottom of at least each container adjacent an end of the carton, said locking tab being struck at least largely from the bottom panel and having a configuration and size to fit within the indentation in the bottom of the container the carton is designed to carry and hold the bottom of the container securely, said locking tab being foldably attached by a fold line to a holding tab which is foldably attached to the bottom panel by a fold line, the distance between said fold lines being at least not significantly greater than the height of the indentation in the bottom of the container the carton is designed to carry; and c. means for holding the tops of the containers near each end of the carton securely within the carton.

2. The carton of claim 1 which is designed to hold cylindrical containers.

3. The carton of claim 1 in which said bottom panel is formed from two bottom flaps that are secured together by locks.

4. The carton of claim 3 in which one of the bottom flaps has a plurality of primary and secondary male locks and the other bottom flap has a plurality of female primary openings and female secondary openings for securing and holding said primary and secondary male locks.

5. The carton of claim 3 in which one of the bottom flaps has a plurality of primary and secondary male locks and the other bottom flap has a plurality of female openings, each of which has a locking ledge for securing a primary male lock and a locking ledge for securing a secondary male lock.

6. The carton of claim 2 in which the means for holding the tops of the containers are four retaining flaps with each retaining flap being foldably attached to the top panel at a location adjacent a side panel and at an open end, said retaining flap being foldably attached to a tuck-in panel that is designed to be wedged between a container the carton is designed to carry and an adjacent side panel, said retaining flap and tuck-in panel being designed to hold the top of a container securely within the carton.

7. The carton of claim 1 which is designed to hold a plurality of containers in two rows extending from one end of the carton to the other.

8. The carton of claim 1 in which each locking tab is largely struck from said bottom panel and with the remainder of said locking tab being struck from the adjacent side panel.

9. The carton of claim 1 which is designed to carry a plurality of cylindrical containers in two rows with a set of a locking tab and a holding tab for each cylindrical container.

10. The carton of claim 9 in which the means for holding the tops of the containers are four retaining flaps with each retaining flap being foldably attached to said top panel at a location adjacent a side panel and at an open end, said retaining flap being foldably attached to a tuck-in panel that is designed to be wedged between a container the carton is designed to carry and an adjacent side panel, said retaining flap and tuck-in panel being designed to hold the top of a container securely within the carton.

11. The carton of claim 10 in which said bottom panel is formed from two bottom flaps with one of the bottom flaps having a plurality of primary and secondary male locks and the other bottom flap having a plurality of female openings, each of which has a locking ledge for securing a primary male lock and a locking ledge for securing a secondary male lock.

12. The carton of claim 9 in which the cylindrical containers the carton is designed to carry have a circular rim with an inside surface surrounding the indentation on the bottom of the container, with each locking tab having an end away from said fold line between said locking tab and said holding tab, said end being curved to fit against the inside surface of the circular rim of the container which is closest to the adjacent side panel of the carton so as to hold the bottom of the container securely in place in the carton.

13. The carton of claim 12 in which each holding tab has a distance between said locking tab and said fold line between said holding tab and said bottom panel that is less than the height of the indentation in the bottom of the container the carton is designed to carry so as to hold said locking tab to which said holding tab is foldably attached tightly against the inside surface of the circular rim in the bottom of the container.

14. The carton of claim 13 in which said bottom panel is formed from two bottom flaps with one of the bottom flaps having a plurality of primary and secondary male locks and the other bottom flap having a plurality of female openings, each of which has a locking ledge for securing a primary male lock and a locking ledge for securing a secondary male lock.

15. The carton of claim 12 in which each holding tab has a distance between said locking tab and said fold line between said holding tab and said bottom panel that is sufficient so that the memory of the material of which said holding tab is constructed tends to return said holding tab to the plane of the material before said holding tab was folded into position, said memory tending to force said locking tab against the inside surface of the circular rim of the container the carton is designed to carry.

16. A wrap-around carton with two open ends containing a plurality of cylindrical containers in two rows, each container having a top and bottom with an indentation with a height in the bottom defined by a circular rim having an inside surface, said carton comprising:

a. a top panel which is interconnected to side panels each of which is connected to a bottom flap;

b. a locking tab which holds the bottom of at least each container adjacent an end of the carton, said locking tab being struck at least largely from a bottom flap, said locking tab having a configuration and size which fits within the indentation in the bottom of the container, said locking tab being foldably attached by a fold line to a holding tab which is foldably attached to said bottom flap by a fold line, the distance between said fold lines being at least not significantly greater than the height of the indentation in the bottom of the container, said holding tab and said bottom flap forming substantially a Z configuration in cross section:

c. means to secure the bottom flaps together; and d. means to hold the tops of the containers adjacent each end securely within said carton.

17. The carton of claim 16 which contains a plurality of cylindrical containers in which the means to secure the bottom flaps together is that one of the bottom flaps has a plurality of primary and secondary male locks and the other bottom flap has a plurality of female primary openings and female secondary openings for securing and holding said primary and secondary male locks.

18. The carton of claim 16 which contains a plurality of cylindrical containers in which the means to secure the bottom flaps together is that one of the bottom flaps has a plurality of primary and secondary male locks and the other bottom flap has a plurality of female openings, each of which has a locking ledge for securing a primary male lock and a locking ledge for securing a secondary male lock.

19. The carton of claim 16 which contains a plurality of cylindrical containers in which the means to hold the tops of the containers adjacent each end securely within the carton are four retaining flaps with each retaining flap being foldably attached to the top panel at a location adjacent a side panel and at an open end, said retaining flap being foldably attached to a tuck-in panel that is wedged between a container and an adjacent side panel, said retaining flap and tuck-in panel holding the top of a container securely within the carton.

20. The carton of claim 16 which contains a plurality of cylindrical containers in which each locking tab was largely struck from a bottom flap with the remainder of said locking tab being struck from the adjacent side panel.

21. The carton of claim 16 which contains a plurality of cylindrical containers in which each locking tab has an end away from said fold line between said locking tab and said holding tab, said end being curved to fit against the inside surface of the circular rim of the container which is closest to the adjacent side panel of the carton so as to hold the bottom of the container securely in place in the carton.

22. The carton of claim 21 which contains a plurality of cylindrical containers in which each holding tab has a distance between said locking tab and said fold line between said holding tab and said bottom panel that is less than the height of the indentation in the bottom of the container so as to hold said locking tab to which said holding tab is foldably attached tightly against the inside surface of the circular rim in the bottom of the container.

23. The carton of claim 22 which contains a plurality of cylindrical containers in which the means to secure said bottom flaps together is that one of the bottom flaps has a plurality of primary and secondary male locks and the other bottom flap has a plurality of female openings, each of which has a locking ledge that secures a primary male lock and a locking ledge that secures a secondary male lock.

24. The carton of claim 16 in which the holding tab is substantially perpendicular to the indentation in the bottom of the container.

* * * * *